US011425947B2

(12) United States Patent
Hiney

(10) Patent No.: US 11,425,947 B2
(45) Date of Patent: Aug. 30, 2022

(54) SLEEVE FOR A GARMENT

(71) Applicant: LULULEMON ATHLETICA CANADA INC., Vancouver (CA)

(72) Inventor: Joshua David Hiney, San Francisco, CA (US)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 206 days.

(21) Appl. No.: 16/193,273

(22) Filed: Nov. 16, 2018

(65) Prior Publication Data

US 2019/0150539 A1 May 23, 2019

Related U.S. Application Data

(60) Provisional application No. 62/587,725, filed on Nov. 17, 2017.

(51) Int. Cl.

| | |
|---|---|
| ***A41D 27/10*** | (2006.01) |
| ***A41D 27/28*** | (2006.01) |
| ***A41D 13/01*** | (2006.01) |
| *A41D 3/00* | (2006.01) |

(52) U.S. Cl.

CPC ..... *A41D 27/10* (2013.01); *A41D 13/01* (2013.01); *A41D 27/28* (2013.01); *A41D 3/00* (2013.01); *A41D 2300/322* (2013.01); *A41D 2400/10* (2013.01); *A41D 2600/10* (2013.01)

(58) Field of Classification Search

CPC .... A41D 27/10; A41D 13/0015; A41D 13/01; A41D 27/28; A41D 27/285; A41D 2400/10; A41D 27/02; A41D 2300/24; A41D 15/002

USPC ..... 2/85, DIG. 1

See application file for complete search history.

(56) References Cited

U.S. PATENT DOCUMENTS

| | | | | | |
|---|---|---|---|---|---|
| 1,177,952 | A * | 4/1916 | Inman | A41D 1/02 | 2/93 |
| 1,508,834 | A * | 9/1924 | Cohen | A41D 27/10 | 2/97 |
| 1,647,656 | A * | 11/1927 | Olsen | A41B 1/00 | 2/115 |
| 2,047,620 | A * | 7/1936 | D Annunzio | A41D 27/10 | 2/93 |
| 2,058,238 | A * | 10/1936 | Kayser | A41D 27/10 | 2/79 |

(Continued)

FOREIGN PATENT DOCUMENTS

| | | | | |
|---|---|---|---|---|
| CA | 2639287 | A1 * | 9/2009 | A41H 3/007 |
| WO | WO-2006038913 | A1 * | 4/2006 | A41D 13/12 |
| WO | WO-2016199322 | A1 * | 12/2016 | A41D 27/28 |

*Primary Examiner* — Alissa L Hoey

(74) *Attorney, Agent, or Firm* — McAndrews Held & Malloy, Ltd.

(57) ABSTRACT

A sleeve for a garment, comprising: a front panel attached to a back panel along respective first and second side edges thereof, the back panel having upper and lower vents formed proximate an elbow portion thereof; and, upper and lower flaps formed on the back panel above and overlapping the upper and lower vents, respectively; wherein the upper and lower flaps are moveable between a closed position when the sleeve is straight through the elbow portion and an opened position when the sleeve is bent at the elbow portion to thereby allow increased airflow through the upper and lower vents when the garment is in use.

16 Claims, 13 Drawing Sheets

(56) References Cited

U.S. PATENT DOCUMENTS 2,079,980 A * 5/1937 Anders ..... A41D 27/28 2/115
2,179,675 A * 11/1939 Trageser ..... A41D 27/10 2/93
2,259,560 A * 10/1941 Glidden ..... A41D 27/28 428/134
2,314,226 A * 3/1943 Lee ..... A41D 27/10 2/94
2,369,416 A 2/1945 Solomon
2,447,989 A * 8/1948 Previdi ..... A41D 27/10 2/125
2,543,317 A * 2/1951 Hammond ..... A41D 27/28 2/82
2,664,570 A * 1/1954 Artzt ..... A41D 15/002 2/78.3
2,700,769 A * 2/1955 Polchinski ..... A41D 27/28 2/93
2,715,226 A * 8/1955 Weiner ..... A41D 27/28 2/79
2,771,661 A * 11/1956 Foster ..... A41D 31/02 428/101
2,839,756 A * 6/1958 Geiss ..... A41D 27/10 2/125
3,086,215 A * 4/1963 Di Paola ..... A41D 27/28 2/93
4,215,435 A * 8/1980 Miele ..... A41D 15/002 2/227
4,608,715 A * 9/1986 Miller ..... A41D 27/285 2/1
D294,305 S 2/1988 Meek
4,722,099 A * 2/1988 Kratz ..... A41D 27/28 2/115
D306,511 S 3/1990 Jones
5,090,058 A * 2/1992 Gerber ..... A41D 27/10 2/97
5,105,477 A 4/1992 Golde
5,168,580 A * 12/1992 Foo ..... A41D 15/00 2/115
5,704,064 A * 1/1998 van der Sleesen .... A41D 27/28 2/69
5,717,999 A * 2/1998 Lurry ..... A41D 15/002 2/108
6,047,404 A * 4/2000 Blanks, I ..... A41D 15/00 2/108
6,085,353 A * 7/2000 van der Sleesen .... A41D 15/04 2/108
6,163,883 A * 12/2000 Hong ..... A41D 27/28 2/69
6,263,510 B1 * 7/2001 Bay ..... A41D 27/28 2/108
D529,687 S 10/2006 Rindle
7,181,774 B2 * 2/2007 Silver ..... A41D 1/08 2/227
D555,878 S 11/2007 Bay
7,353,545 B1 * 4/2008 Blauer ..... A41D 13/01 2/115
7,540,037 B1 * 6/2009 Bittier ..... A41D 13/0543 2/69
D612,580 S * 3/2010 Hall ..... D2/739
D618,440 S 6/2010 Parker
D620,231 S 7/2010 Parker
D641,137 S 7/2011 Evans et al.
D641,138 S 7/2011 Santo et al.
D643,597 S 8/2011 Gaeir et al.
D654,664 S 2/2012 Evans et al.
D657,532 S * 4/2012 Gaeir ..... D2/840
D685,158 S 7/2013 Lambertz
D691,782 S 10/2013 Meredith
8,601,612 B2 * 12/2013 Funk-Danielson .... A45C 13/10 2/123
D698,525 S 2/2014 Roberts et al.
8,661,563 B2 3/2014 Evans et al.
8,713,712 B2 * 5/2014 Maurer ..... A41D 27/28 2/93
D713,130 S 9/2014 Boyle et al.
D738,594 S 9/2015 Boyle et al.
D746,550 S 1/2016 Roberts et al.
D749,823 S 2/2016 Grosbol
D778,033 S 2/2017 Darmour
D790,807 S 7/2017 Darmour
9,974,346 B2 * 5/2018 Beneyto-Ferre ..... A41D 27/285
9,974,347 B2 * 5/2018 Audet ..... A41D 31/0027
10,092,050 B2 10/2018 Skurla, III
D836,887 S 1/2019 Aitch
D843,688 S 3/2019 Pfanner
10,244,804 B2 * 4/2019 Hodgson ..... A41D 3/04
D872,423 S 1/2020 Hiney
10,687,572 B2 * 6/2020 Baker ..... A41D 27/28
2003/0019009 A1 * 1/2003 Feduzi ..... A41D 13/01 2/69
2004/0055069 A1 3/2004 Clarke Fayle et al.
2004/0143882 A1 * 7/2004 Gardner ..... A41D 13/01 2/81
2005/0166298 A1 * 8/2005 Pieroranzio ..... A41D 1/06 2/69
2006/0064797 A1 * 3/2006 Pyeatt Rowe ..... A41D 15/00 2/244
2006/0107437 A1 * 5/2006 Griesbach, III ..... A41D 15/002 2/114
2006/0277652 A1 * 12/2006 Okajima ..... A41D 13/00 2/93
2008/0005825 A1 1/2008 Tronvold
2009/0178174 A1 * 7/2009 Cash, Jr. ..... A41D 27/28 2/69
2009/0249529 A1 10/2009 Rodriguez et al.
2010/0108247 A1 * 5/2010 King ..... A41D 13/01 156/247
2010/0199404 A1 * 8/2010 Garza ..... A41D 3/02 2/84
2013/0031703 A1 * 2/2013 Curtis ..... A62B 17/003 2/455
2013/0254969 A1 * 10/2013 Getzen ..... A41B 1/10 2/108
2014/0196192 A1 * 7/2014 Koller ..... A41D 3/00 2/85
2014/0259269 A1 * 9/2014 Clements ..... A41D 13/01 2/69
2015/0374050 A1 * 12/2015 Farron ..... A41D 3/00 2/95
2016/0242474 A1 * 8/2016 Baschak ..... A41D 31/102
2016/0366954 A1 * 12/2016 Barkshire ..... A41D 13/01
2017/0035122 A1 * 2/2017 Farron ..... A41D 3/00
2017/0065005 A1 * 3/2017 Nordstrom ..... A41D 27/28
2017/0099899 A1 * 4/2017 Pezzimenti ..... A41D 27/04
2017/0105466 A1 * 4/2017 Baschak ..... A41D 27/28
2017/0172237 A1 * 6/2017 Martin ..... A41D 27/10
2017/0290382 A1 * 10/2017 Arnold ..... A41D 31/102
2018/0098584 A1 * 4/2018 Pezzimenti ..... A41D 27/24
2018/0271193 A1 * 9/2018 Aitch ..... A41D 1/04
2019/0365000 A1 * 12/2019 Simmons ..... A41D 27/28
2020/0170316 A1 * 6/2020 Barski ..... A41D 15/002

* cited by examiner

SLEEVE FOR A GARMENT

CROSS REFERENCE TO RELATED APPLICATIONS

This application claims priority from and the benefit of the filing date of U.S. Provisional Patent Application No. 62/587,725, filed Nov. 17, 2017, and the entire content of such application is incorporated herein by reference.

FIELD OF THE APPLICATION

This application relates to the field of sports apparel, and more specifically, to a sleeve for a garment such as a running jacket.

BACKGROUND OF THE APPLICATION

Consumers are demanding high performance activewear and sportswear. This is especially so for garments used for running such as running jackets and pullovers. Such garments should be as light as possible but must still provide adequate insulation for cold weather and effective weatherproofing for wet weather. Moreover, such garments should provide adequate ventilation to keep a wearer from overheating even in cold and wet weather.

One problem with existing running jackets is that when they are insulated for use in cold weather and/or weatherproofed for use in wet weather, a wearer may become overheated due to a lack of effective ventilation. Waterproof fabrics may also be rigid, lack stretch, and restrict mobility. These drawbacks are especially problematic with respect to the sleeves of such garments.

A need therefore exists for an improved sleeve for a garment. Accordingly, a solution that addresses, at least in part, the above and other shortcomings is desired.

SUMMARY OF THE APPLICATION

According to one aspect of the application, there is provided a sleeve for a garment, comprising: a front panel attached to a back panel along respective first and second side edges thereof, the back panel having upper and lower vents formed proximate an elbow portion thereof; and, upper and lower flaps formed on the back panel above and overlapping the upper and lower vents, respectively; wherein the upper and lower flaps are moveable between a closed position when the sleeve is straight through the elbow portion and an opened position when the sleeve is bent at the elbow portion to thereby allow increased airflow through the upper and lower vents when the garment is in use. When in the opened position, the upper and lower flaps are separated from but remain overlapping the respective upper edges of the middle and lower panels.

According to another aspect of the application, there is provided a ventilated sleeve for a garment, comprising: a sleeve having an elbow portion and first and second openings formed in the sleeve proximate the elbow portion; and, first and second flaps formed on the sleeve above and overlapping the first and second openings, respectively; wherein the first and second flaps are moveable between a closed position when the sleeve is straight through the elbow portion and an opened position when the sleeve is bent at the elbow portion to thereby allow increased airflow through the first and second openings when the garment is in active use.

BRIEF DESCRIPTION OF THE DRAWINGS

Features and advantages of the embodiments of the present application will become apparent from the following detailed description, taken in combination with the appended drawings, in which.

It will be noted that throughout the appended drawings, like features are identified by like reference numerals.

DETAILED DESCRIPTION OF EXAMPLE EMBODIMENTS

In the following description, details are set forth to provide an understanding of the application. In some instances, certain structures, techniques, and methods have not been described or shown in detail in order not to obscure the application.

Figure 1:
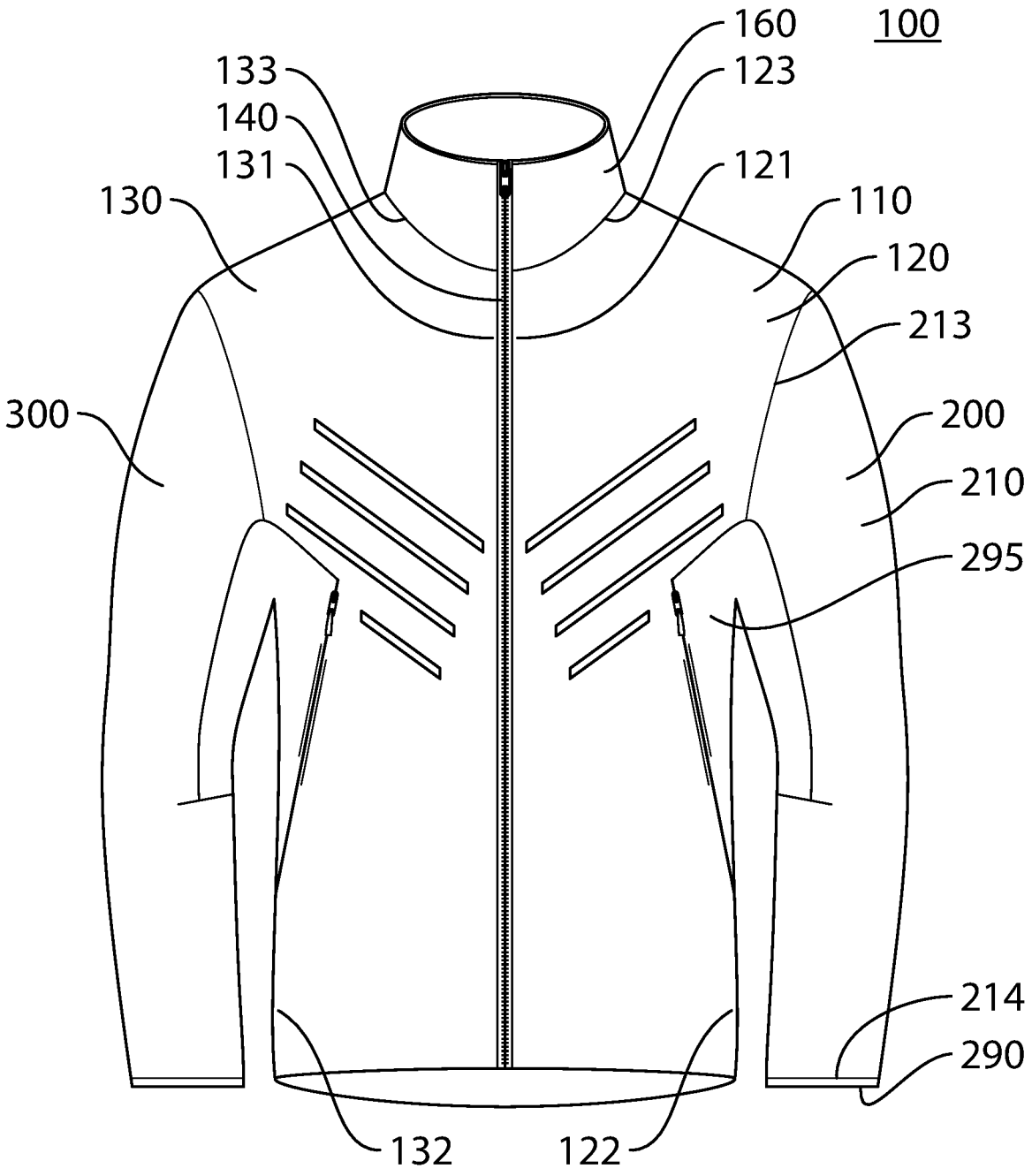
FIG. 1 is a front view illustrating a garment with the vents formed in the sleeves thereof shown in a closed position in accordance with an embodiment of the application.
Figure 2:
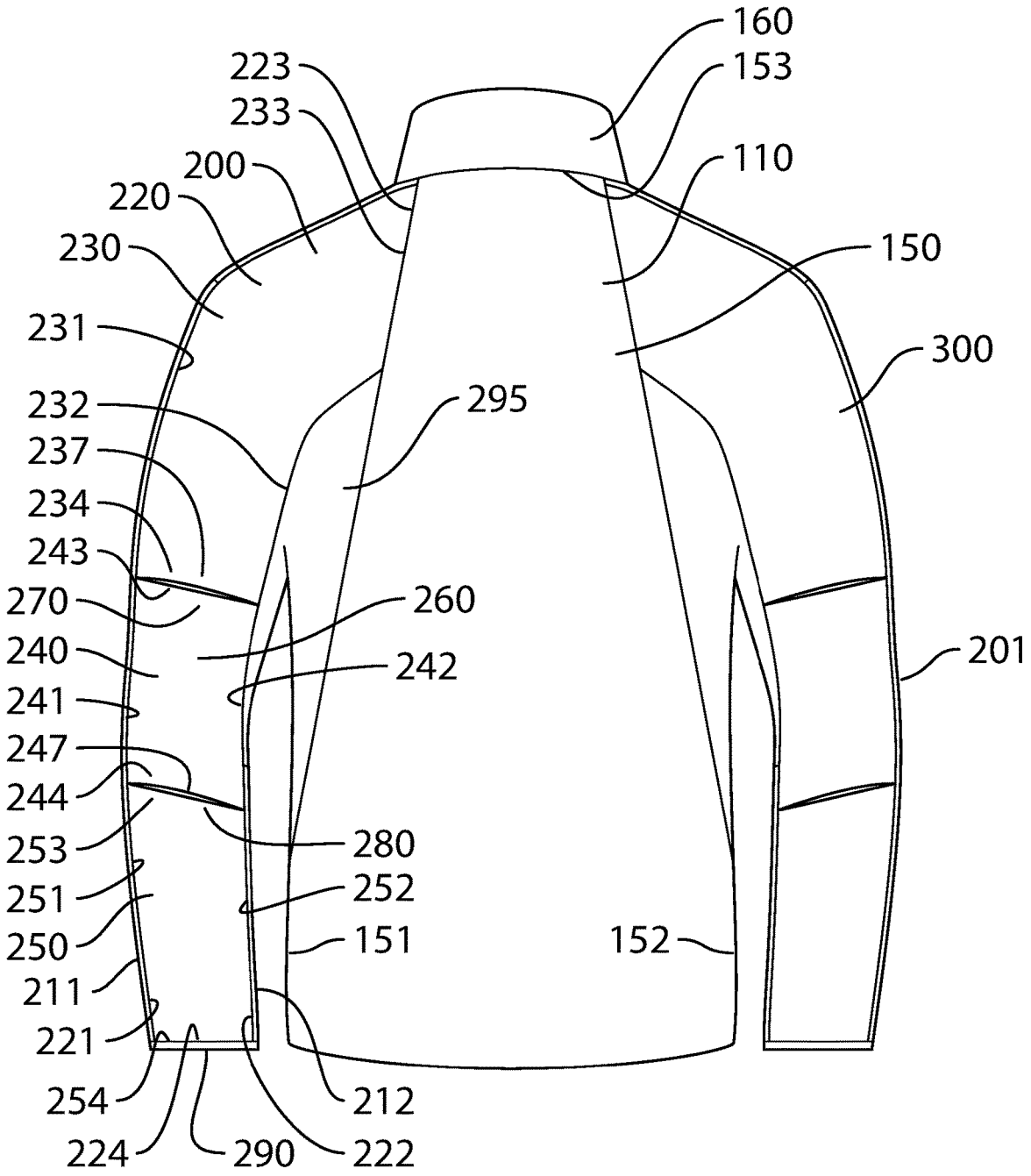
FIG. 2 is rear view thereof.
Figure 3:
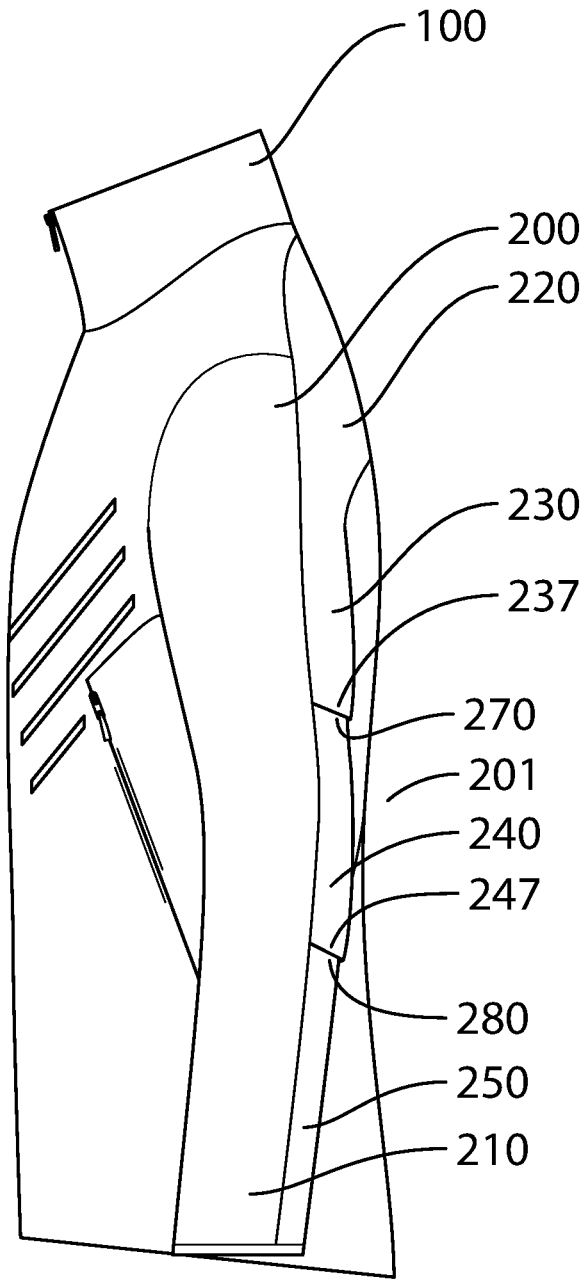
FIG. 3 is a right side view thereof.
Figure 4:
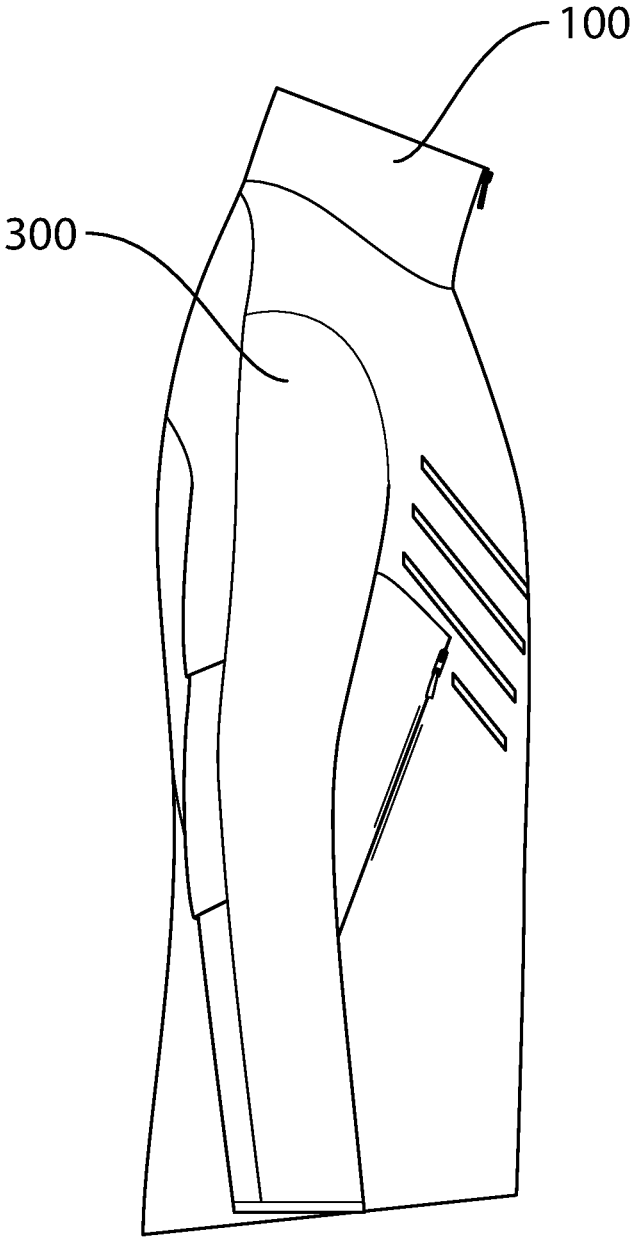
FIG. 4 is a left side view thereof.
Figure 5:
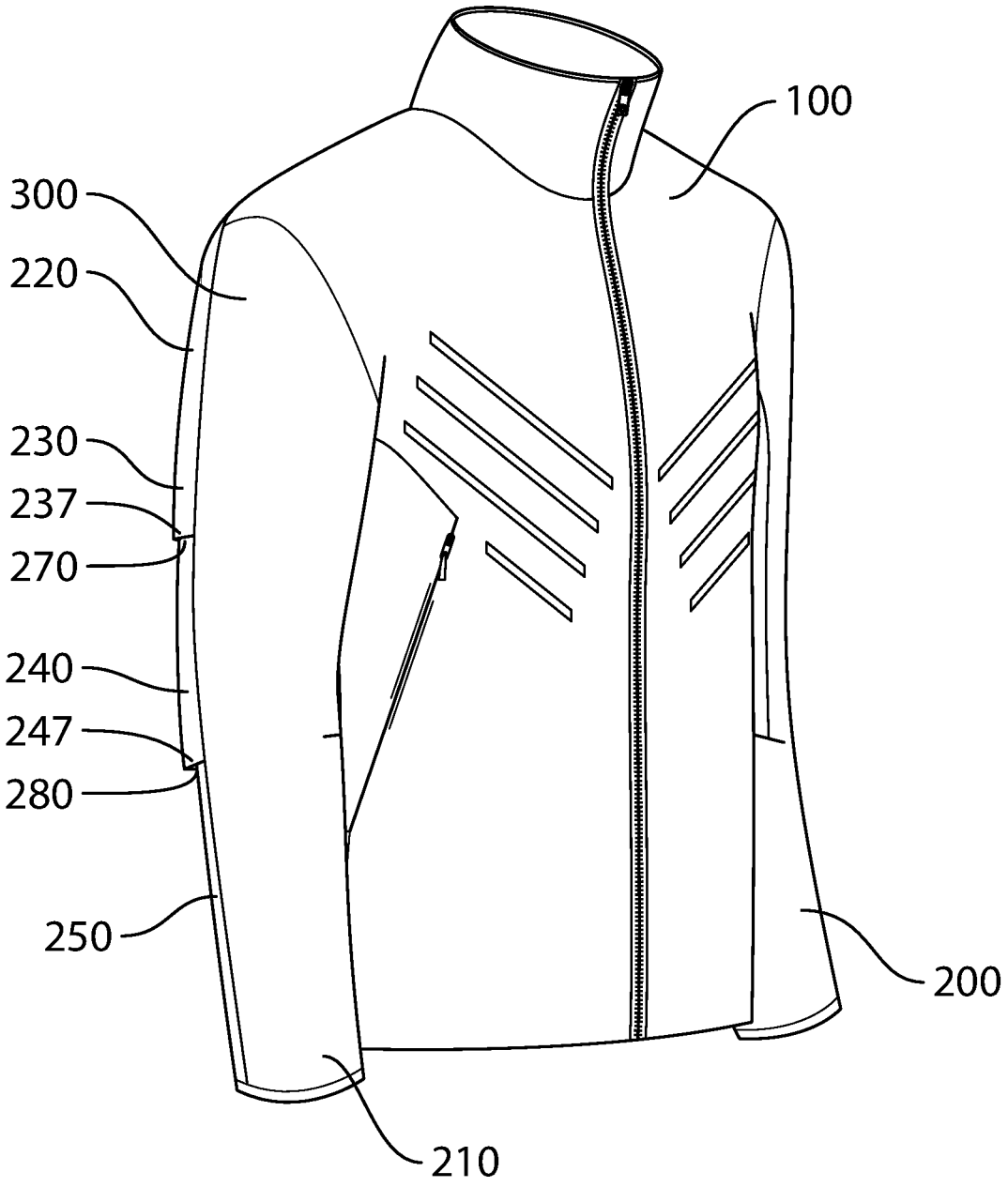
FIG. 5 is a front perspective view thereof.
Figure 6:
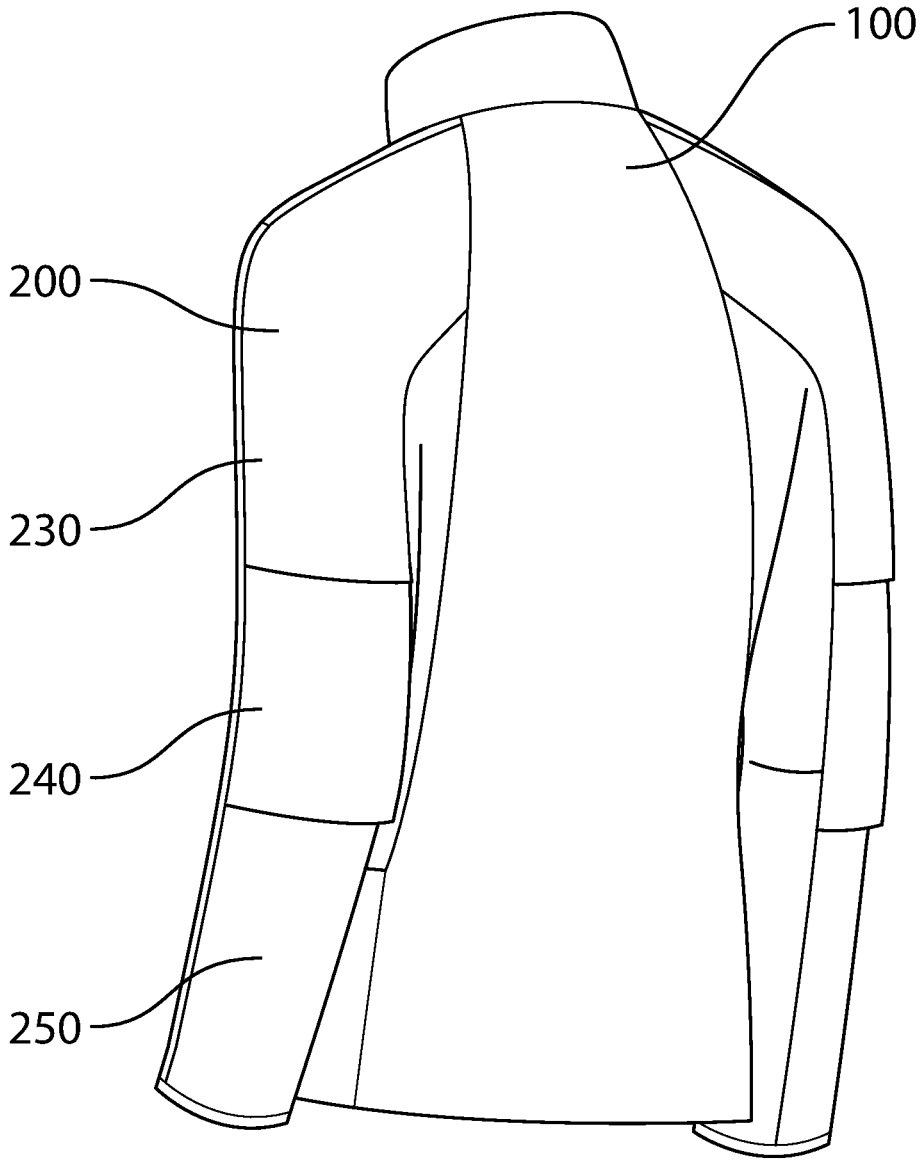
FIG. 6 is a rear perspective view thereof.
Figure 7:
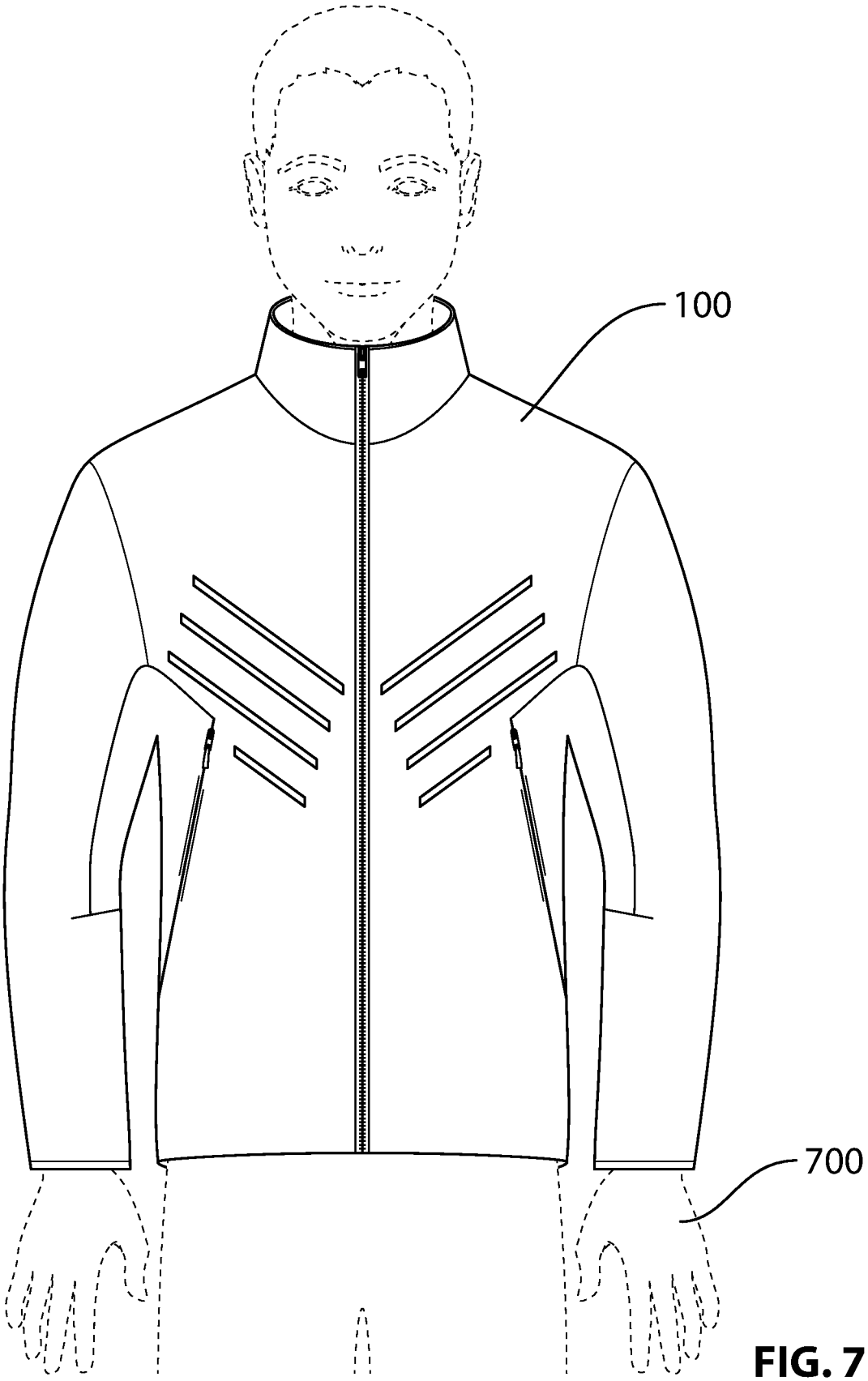
FIG. 7 is a front environmental view thereof illustrating the positioning of the garment on a wearer's body.

FIG. 1 is a front view illustrating a garment 100 with the vents 270, 280 formed in the sleeves 200, 300 thereof shown in a closed position 201 in accordance with an embodiment of the application. FIG. 2 is rear view thereof. FIG. 3 is a right side view thereof. FIG. 4 is a left side view thereof. FIG. 5 is a front perspective view thereof. FIG. 6 is a rear perspective view thereof. And, FIG. 7 is a front environmental view thereof illustrating the positioning of the garment 100 on a wearer's body 700.

According to one embodiment of the application, a garment 100 such as a sports garment, jacket, or running jacket is provided. The garment 100 includes a body portion or body 110 and first and second or right and left sleeves 200, 300 attached or connected (e.g., glued, sewn, etc.) to the body 110.

The body 110 includes: first and second or right and left front body panels (or fabric panels) 120, 130 closable by a fastening means such as a zipper 140 attached to respective inner side edges 121, 131 of the first and second front body panels 120, 130; a rear body panel (or fabric panel) 150 attached at either side edge 151, 152 to respective outer side edges 122, 132 of the first and second front body panels 120, 130; and, a collar 160 attached to the upper edges 123, 133, 153 of the first, second, and rear body panels 120, 130, 150.

According to one embodiment, each sleeve (e.g., 200) includes a front panel (or fabric panel) 210 attached to a back panel (or fabric panel) 220 along respective first 211, 221 and second side edges 212, 222 thereof. The front and back panels 210, 220 may be elongate and tapered from shoulder to cuff forming the tubular fabric sleeve 200. The back panel 220 may include an upper panel 230, a middle panel 240, and a lower panel 250, the middle panel 240 being positioned between the upper and lower panels 230, 250 and forming or including an elbow portion 260 of the sleeve 200. The lower edge 234 of the upper panel 230 may overlap (or overhang) the upper edge 243 of the middle panel 240 forming a first or upper opening or vent 270 in the sleeve 200 above the elbow portion 260. In addition, the lower edge 244 of the middle panel 240 may overlap the upper edge 253 of the lower panel 250 forming a second or lower opening or vent 280 in the sleeve 200 below the elbow portion 260. Note that the lower edge 234 of the upper panel 230 and the upper edge 243 of the middle panel 240 are not attached together. Similarly, the lower edge 244 of the middle panel 240 is not attached to the upper edge 253 of the lower panel 250. Thus, the upper panel 230 (or at least the lower edge 234 of the upper panel 230) forms a first or upper flap 237 overlapping the upper vent 270. Similarly, the middle panel 240 (or at least the lower edge 244 of the middle panel 240) forms a second or lower flap 247 overlapping the lower vent 280.

The respective upper edges 213, 223 of the front and back panels 210, 220 may be attached to the body 110 of the garment 100 and the respective lower edges 214, 224 of the front and back panels 210, 220 may form a cuff 290 of the sleeve 200.

The respective first 231, 241, 251 and second side edges 232, 242, 252 of the upper, middle, and lower panels 230, 240, 250 may form at least a respective portion of the first 221 and second side edges 222 of the back panel 220. In addition, the upper edge 233 of the upper panel 230 may form at least a portion of the upper edge 223 of the back panel 220 and the lower edge 254 of the lower panel 250 may form at least a portion of the lower edge 224 of the back panel 220. According to one embodiment, the front panel 210 (and/or body 110) includes a gusset portion 295 for attaching the sleeve 200 to the body 110 of the garment 100.

According to one embodiment, each sleeve (e.g., 200) may include only one of the upper and lower vents 270, 280. According to another embodiment, each sleeve 200 may include more than two vents 270, 280 (e.g., three, four, etc.). According to other embodiments, both the upper and lower vents 270, 280 may be positioned above the elbow or elbow portion 260 of the sleeve 200, both the upper and lower vents 270, 280 may be positioned below the elbow or elbow portion 260 of the sleeve 200, and/or one of the upper and lower vents 270, 280 may be positioned at or on the elbow or elbow portion 260 of the sleeve 200.

Figure 8:
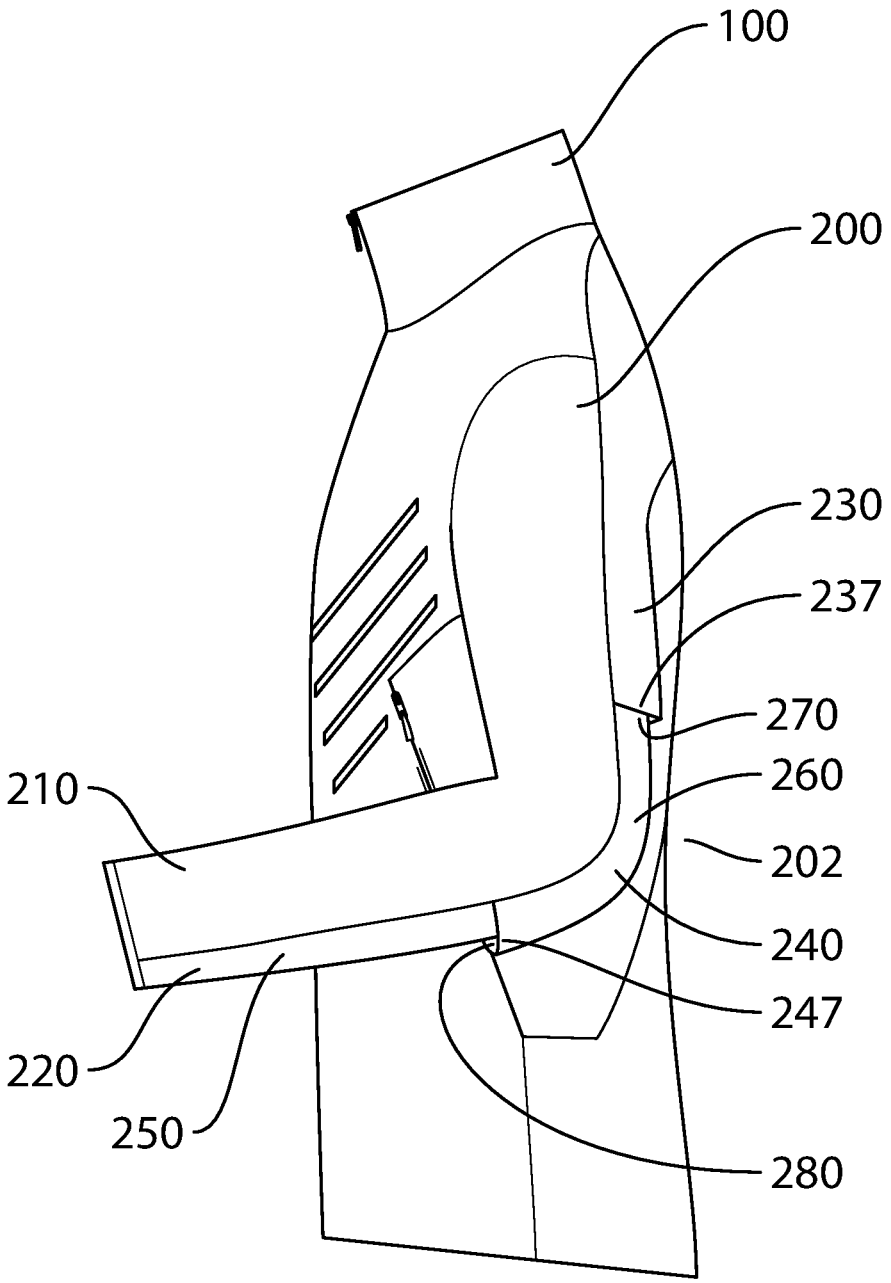
FIG. 8 is a right side view illustrating the garment of FIG. 1 with the vents formed in the sleeves thereof shown in an opened position in accordance with an embodiment of the application.
Figure 9:
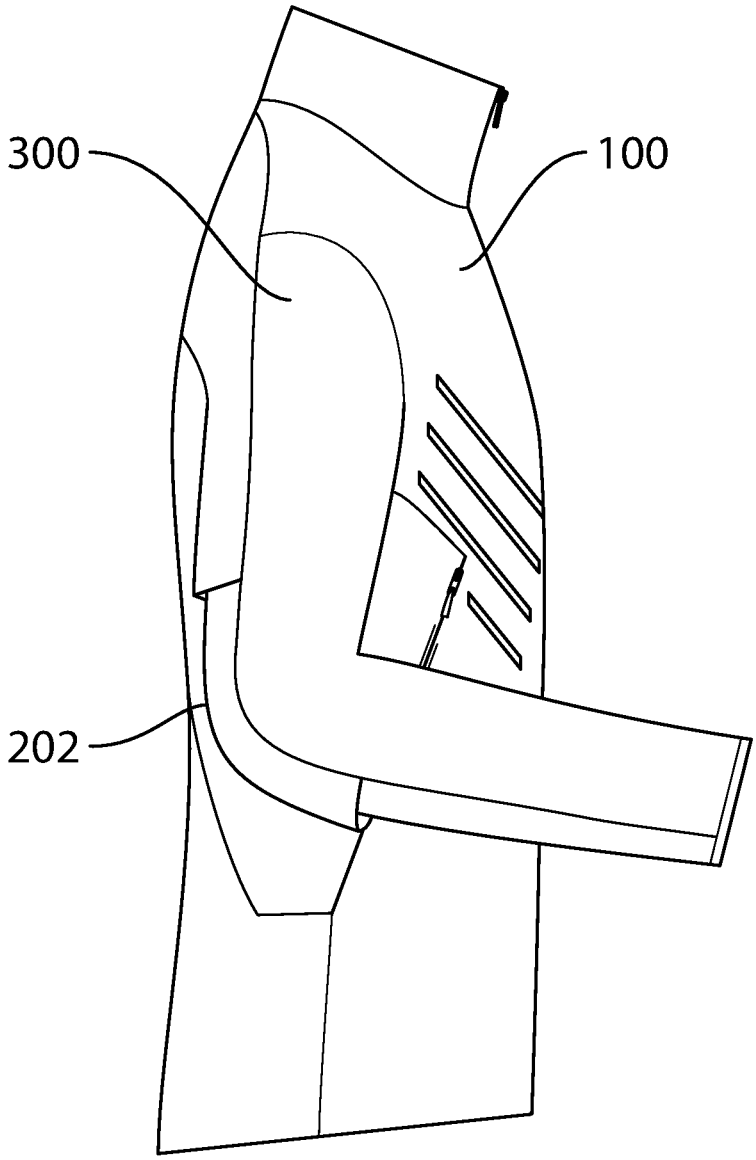
FIG. 9 is a left side view thereof.
Figure 10:
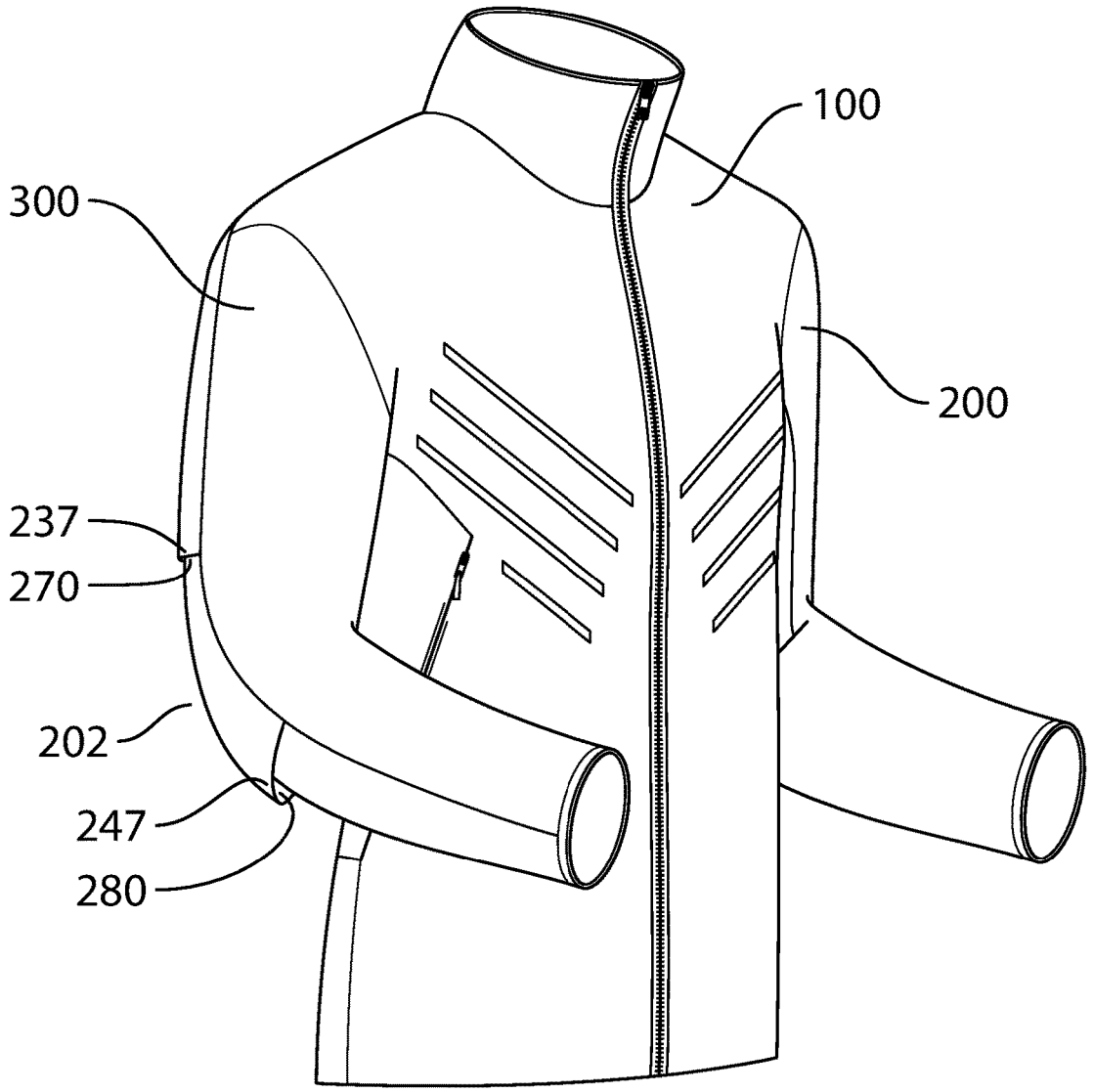
FIG. 10 is a front perspective view thereof.
Figure 11:
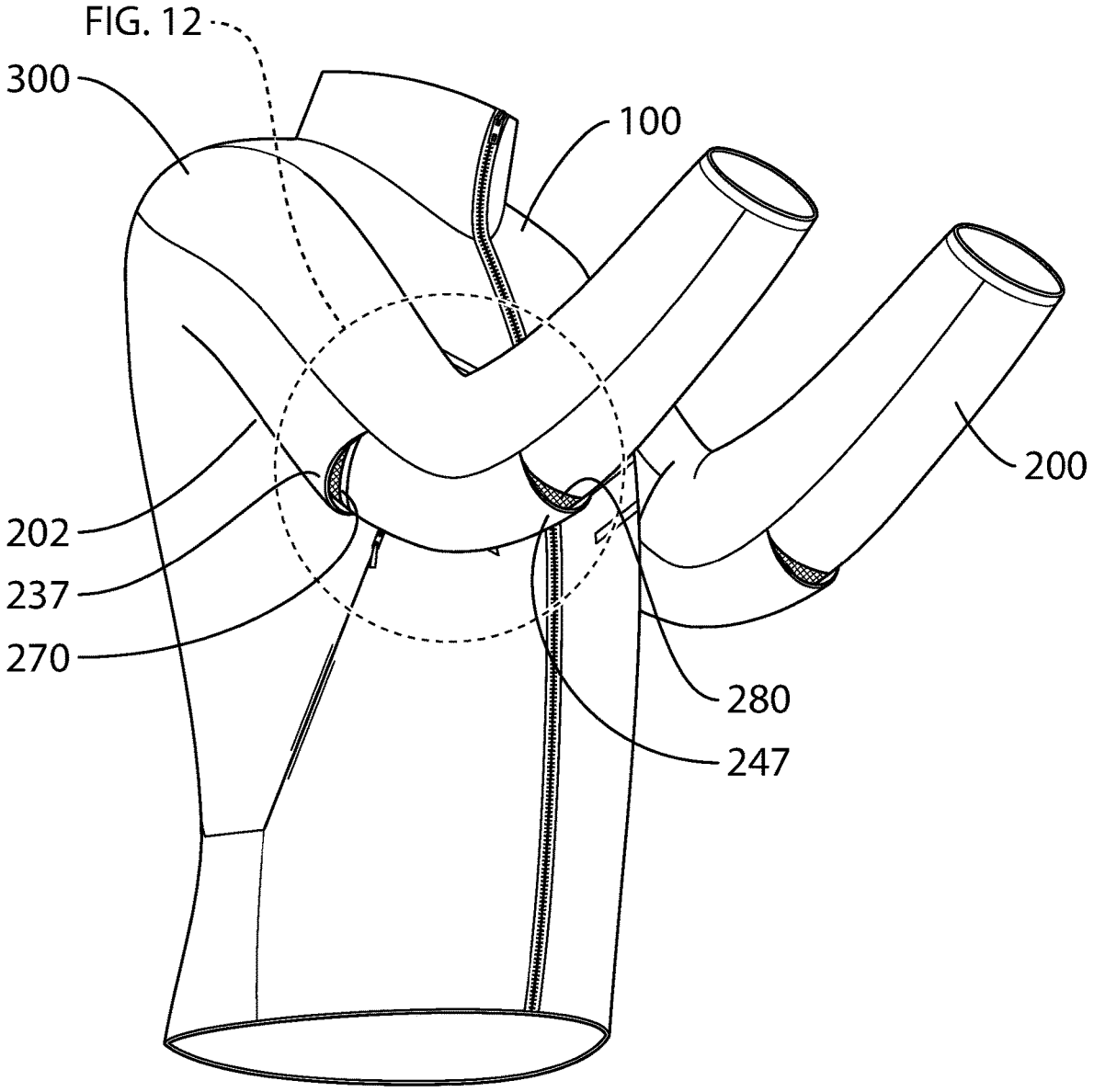
FIG. 11 is a front bottom perspective view thereof.
Figure 12:
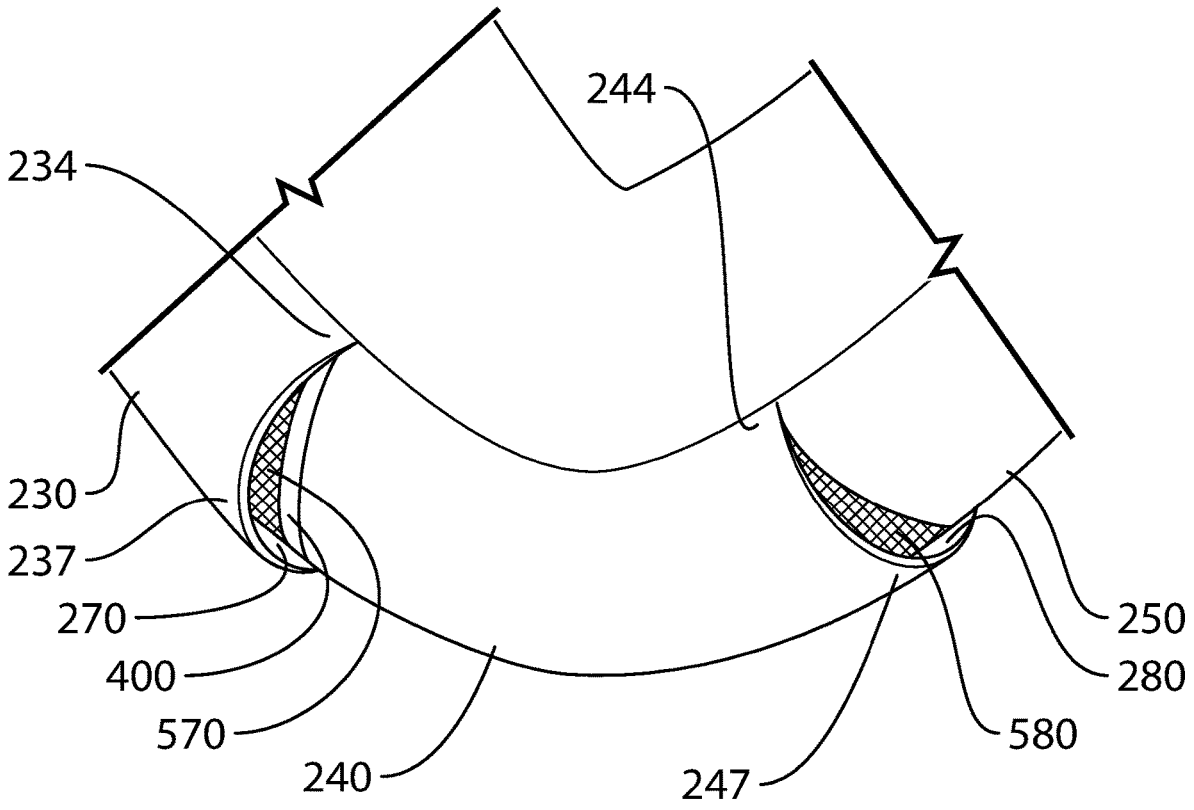
FIG. 12 is a front bottom perspective detail view thereof illustrating the reflective strip positioned under the upper flap; and, FIG. 13 is a side view illustrating a lining panel for a sleeve of the garment of FIG. 1 in accordance with an embodiment of the application.

FIG. 8 is a right side view illustrating the garment 100 of FIG. 1 with the vents 270, 280 formed in the sleeves 200, 300 thereof shown in an opened position 202 in accordance with an embodiment of the application. FIG. 9 is a left side view thereof. FIG. 10 is a front perspective view thereof. FIG. 11 is a front bottom perspective view thereof. And, FIG. 12 is a front bottom perspective detail view thereof illustrating the reflective strip 400 positioned under the upper flap 237.

According to one embodiment, each sleeve (e.g., 200) is moveable between a straight position in which the elbow portion 260 of the sleeve 200 is straight or approximately straight through the elbow portion 260 and a bent position in which the elbow portion 260 of the sleeve 200 is bent. When the sleeve 200 is straight, the upper and lower flaps 237, 247 are in a closed position 201 and the upper and lower vents 270, 280 are covered or at least partially covered. In particular, in the closed position 201, the lower edges 234, 244 of the upper and middle panels 230, 240 overlap the upper edges 243, 253 of the middle and lower panels 240, 250, respectively. When the sleeve 200 is bent, the upper and lower flaps 237, 247 are in an opened position 202 and the upper and lower vents 270, 280 are uncovered or at least partially uncovered. In particular, in the opened position 202, the lower edges 234, 244 of the upper and middle panels 230, 240 are separated from at least the central portion of the upper edges 243, 253 of the middle and lower panels 240, 250, respectively. The bending of the sleeve 200 at the elbow portion 260, when a wearer bends his or her elbow, causes at least the central portion of the upper edges 243, 253 of the middle and lower panels 240, 250 to be pulled or stretched down and away in a hinge-like manner from the lower edges 234, 244 of the upper and middle panels 230, 240, thus uncovering the upper and lower vents 270, 280. In the opened position 202, the upper and lower flaps 237, 247 function as air scoops to direct air through the upper and lower vents 270, 280 and into the sleeve 200 of the garment 100.

Advantageously, when the wearer is running or otherwise bending his or her elbows in active use, the upper and lower flaps 237, 247 move between the closed position 201 (when the sleeve 200 is straight through the elbow portion 260) and the opened position 202 (when the sleeve 200 is bent at the elbow portion 260) which allows for increased airflow through the upper and lower vents or openings 270, 280 when the garment 100 is in such use. When the wearer is walking or standing, the sleeve 200 is typically straight such as at the side of the wearer's body and hence the upper and lower flaps 237, 247 return to the closed position 201. In the closed position 201, the upper and lower vents or openings 270, 280 are covered which prevents or inhibits wind, rain, or snow from entering the sleeve 200 keeping the wearer warm and dry. Furthermore, the presence of the upper and lower vents or openings 270, 280 improves articulation, mobility, and flexibility of the sleeve 200. When in the opened position, the upper and lower flaps 237, 247 are separated from but remain overlapping the respective upper edges 243, 253 of the middle and lower panels 240, 250.

According to one embodiment, each sleeve (e.g., 200) may include a reflective material 400 positioned on the middle panel 240 proximate the upper edge thereof 243. The reflective material 400 may be a horizontal or approximately horizontal strip of reflective material, fabric, or coating. The reflective material 400 is covered by the lower edge 234 of the upper panel 230 (i.e., the upper flap 237) and is not visible when the sleeve 200 is straight and the upper flap 237 is in the closed position 201. In addition, the reflective material 400 is uncovered by the lower edge 234 of the upper panel 230 (i.e., the upper flap 237) and is visible when the sleeve 200 is bent and the upper flap 237 is in the opened position 202.

Figure 13:
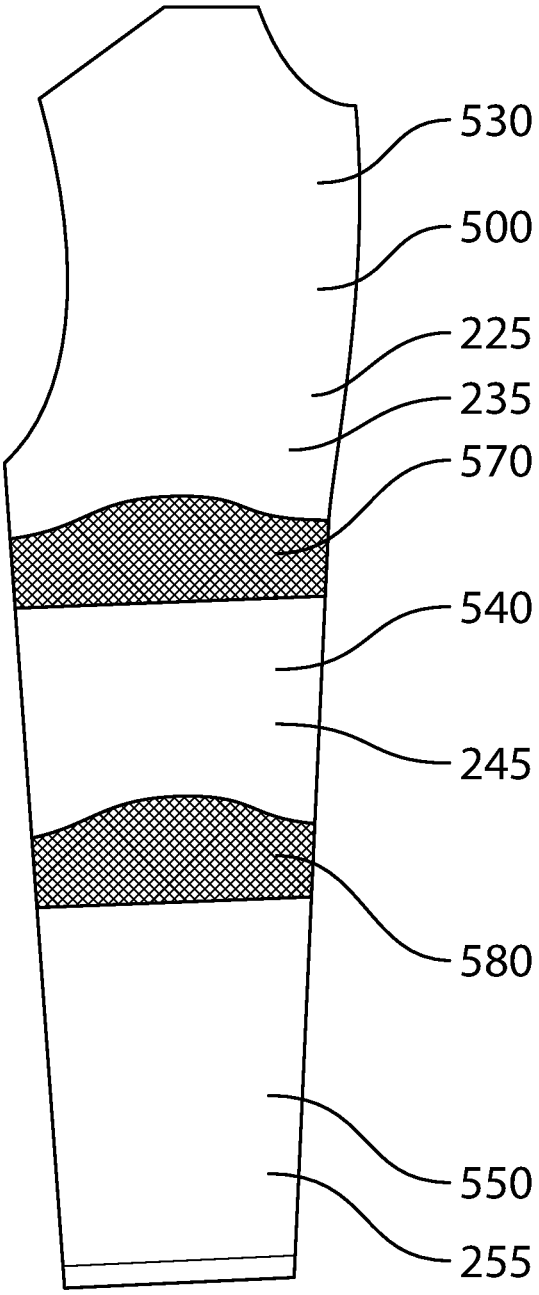

FIG. 13 is a side view illustrating a lining panel 500 for a sleeve (e.g., 200) of the garment 100 of FIG. 1 in accordance with an embodiment of the application. Each sleeve (e.g., 200) may include respective breathable mesh linings 570, 580 attached over each of the upper and lower vents 270, 280 on an inner side 225 of the back panel 220. The mesh linings 570, 580 allow ventilating air to enter and exit the sleeve 200.

According to one embodiment, each sleeve (e.g., 200) may include respective insulating linings 530, 540, 550 attached to respective inner sides 235, 245, 255 of at least one of the front panel 210, back panel 220, the upper panel 230, the middle panel 240, and the lower panel 250.

According to one embodiment, at least one of the front panel 210, the upper panel 230, the middle panel 240, and the lower panel 250 are made from a weatherproof material or fabric or are coated with a weatherproofing agent.

In operation, a wearer puts on the garment 100 by inserting his or her arms into the sleeves 200, 300 and pulling up the zipper 140. When the wearer is walking or standing, his or her arms are generally at his or her sides, the sleeves 200, 300 are straight or approximately straight, the vents 270, 280 in each sleeve (e.g., 200) of the garment 100 are in the closed position 201, and the wearer is protected from the elements. When the wearer begins running or otherwise bending his or her arms in active use, the sleeves 200, 300 are bent, the vents 270, 280 in each sleeve 200 of the garment 100 move to the open position 202 allowing increased airflow through the vents 270, 280, and the wearer is cooled. In the opened position 202, the upper and lower flaps 237, 247 function as air scoops to direct air through the vents 270, 280 and into the sleeve 200 of the garment 100.

Thus, according to one embodiment, there is provided a sleeve (e.g. 200) for a garment 100, comprising: a front panel 210 attached to a back panel 220 along respective first 211, 221 and second side edges 212, 222 thereof, the back panel 220 having upper and lower vents 270, 280 formed proximate (e.g., above and below, on, at, both below, both above, etc.) an elbow portion 260 thereof; and, upper and lower flaps 237, 247 formed on the back panel 220 above and overlapping the upper and lower vents 270, 280, respectively; wherein the upper and lower flaps 237, 247 are moveable between a closed position 201 when the sleeve 200 is straight through the elbow portion 260 and an opened position 202 when the sleeve is bent at the elbow portion 260 to thereby allow increased airflow through the upper and lower vents 270, 280 when the garment is in use (e.g., active use by a wearer such as running, etc.).

The above sleeve 200 may further include a reflective material 400 attached on the back panel 220 below the upper vent 270. The reflective material 400 may be covered by the upper flap 237 and may not be visible when the upper flap 237 is in the closed position 201 and the reflective material 400 may be uncovered by the upper flap 237 and may be visible when the upper flap 237 is in the opened position 202. The sleeve 200 may further include respective breathable mesh linings 570, 580 attached over each of the upper and lower vents 270, 280 on an inner side 225 of the back panel 220. The sleeve may further include an insulating lining (e.g., 530, 540, 550) attached to an inner side (e.g., 225) of the sleeve 200. At least one of the front and back panels 210, 220 may be made from a weatherproof fabric or coated with a weatherproofing agent. The garment 100 may be one or more of a sports garment, a jacket, and a running jacket. Respective upper edges 213, 223 of the front and back panels 210, 220 may be attached to a body 110 of the garment 100 and respective lower edges 214, 224 of the front and back panels 210, 220 may form a cuff 290 of the sleeve 200. The front panel 210 may include a gusset portion 295 for attaching to the body 110 of the garment 100.

In the above sleeve 200, the back panel 220 may include an upper panel 230, a middle panel 240, and a lower panel 250, the middle panel 240 being positioned between the upper and lower panels 230, 250 and forming the elbow portion 260 of the back panel 220. A lower edge 234 of the upper panel 240 may overlap an upper edge 243 of the middle panel 240 forming the upper vent 270 in the sleeve 200 above the elbow portion 260; and, a lower edge 244 of the middle panel 240 may overlap an upper edge 253 of the lower panel 250 forming the lower vent 280 in the sleeve 200 below the elbow portion 260. In the closed position 201, the upper and lower vents 270, 280 may be closed by overlapping of the lower edges 234, 244 of the upper and middle panels 230, 240 over the upper edges 243, 253 of the middle and lower panels 240, 250, respectively; and, in the opened position 202, the upper and lower vents 270, 280 may be opened by separation of the lower edges 234, 244 of the upper and middle panels 230, 240 from the upper edges 243, 253 of the middle and lower panels 240, 250, respectively. A reflective material 400 may be attached on the middle panel 240 proximate the upper edge 243 thereof. The reflective material 400 may be covered by the lower edge 234 of the upper panel 230 and may not be visible when the upper flap 237 is in the closed position 201 and the reflective material 400 may be uncovered by the lower edge 234 of the upper panel 230 and may be visible when the upper flap 237 is in the opened position 202. The sleeve 200 may further include respective breathable mesh linings 570, 580 attached over each of the upper and lower vents 270, 280 on an inner side 225 of the back panel 220. The sleeve 200 may further include respective insulating linings 530, 540, 550 attached to respective inner sides 235, 245, 255 of at least one of the front panel 210, the upper panel 230, the middle panel 240, and the lower panel 250. At least one of the front panel 210, the upper panel 230, the middle panel 240, and the lower panel 250 may be made from a weatherproof fabric or coated with a weatherproofing agent. Respective first 231, 241, 251 and second side edges 232, 242, 252 of the upper, middle, and lower panels 230, 240, 250 may form at least a respective portion of the first 211 and second side edges 212 of the back panel 210, an upper edge 233 of the upper panel 230 may form at least a portion of the upper edge 223 of the back panel 220, and a lower edge 254 of the lower panel 250 may form at least a portion of the lower edge 224 of the back panel 220. And, at least one of: the upper vent 270 may be positioned above the elbow portion 260 and the lower vent 280 may be positioned below the elbow portion 260; the upper and lower vents 270, 280 may both be positioned above the elbow portion 260; the upper and lower vents 270, 280 may both be positioned below the elbow portion 260; and, one of the first and second vents 270, 280 may be positioned on or at the elbow portion 260.

According to another embodiment, there is provided a ventilated sleeve 200 for a garment 100, comprising: a sleeve 200 having an elbow portion 260 and first and second openings 270, 280 formed in the sleeve 200 proximate (e.g., above and below, on, at, both below, both above, etc.) the elbow portion 260; and, first and second flaps 237, 247 formed on the sleeve 200 above and overlapping the first and second openings 270, 280, respectively; wherein the first and second flaps 237, 247 are moveable between a closed position 201 when the sleeve 200 is straight through the elbow portion 260 and an opened position 202 when the sleeve 200 is bent at the elbow portion 260 to thereby allow increased airflow through the first and second openings 270, 280 when the garment 100 is in active use. The above ventilated sleeve 200 may further include respective breathable mesh linings 570, 580 attached over each of the first and second openings 270, 280 on an inner side 225 of the sleeve 200. And, at least one of: the first opening 270 may be positioned above the elbow portion 260 and the second opening 280 may be positioned below the elbow portion 260; the first and second openings 270, 280 may both be positioned above the elbow portion 260; the first and second openings 270, 280 may both be positioned below the elbow portion 260; and, one of the first and second openings 270, 280 may be positioned on or at the elbow portion 260.

The above embodiments may contribute to an improved sleeve (e.g., 200) for a garment 100 and may provide one or more advantages. First, when a wearer is running or otherwise bending his or her elbows in active use, the upper and lower flaps 237, 247 move between the closed position 201 (when the sleeve 200 is straight through the elbow portion 260) and the opened position 202 (when the sleeve 200 is bent at the elbow portion 260) which allows for increased airflow through the uncovered upper and lower vents or openings 270, 280. Second, when the wearer is walking or standing, the sleeve 200 is typically straight such as at the side of the wearer's body and hence the upper and lower flaps 230, 240 return to the closed position 201. In the closed position 201, the upper and lower vents or openings 270, 280 are covered which prevents or inhibits wind, rain, or snow from entering the sleeve 200 keeping the wearer warm and dry. Third, the presence of the upper and lower vents or openings 270, 280 improves articulation, mobility, and flexibility of the sleeve 200.

The embodiments of the application described above are intended to be examples only. Those skilled in the art will understand that various modifications of detail may be made to these embodiments, all of which come within the scope of the application.

What is claimed:

1. A sleeve for a garment, comprising:

a front panel;

a back panel attached to the front panel along respective first and second side edges thereof forming the sleeve, the back panel having:

an upper panel, a middle panel, and a lower panel, the middle panel being positioned between the upper and lower panels and forming an elbow portion of the sleeve;

wherein a lower edge of the upper panel overlaps an upper edge of the middle panel without attachment thereto forming both an upper opening in the sleeve above the elbow portion thereof and an upper flap overlapping the upper opening; and, wherein a lower edge of the middle panel overlaps an upper edge of the lower panel without attachment thereto forming both a lower opening in the sleeve below the elbow portion thereof and a lower flap overlapping the lower opening;

wherein the upper and lower flaps are moveable between a closed position when the sleeve is straight through the elbow portion and an opened position when the sleeve is bent at the elbow portion to thereby direct increased airflow through the upper and lower openings when the garment is in use; and, wherein the upper and lower flaps are separated from but remain overlapping the respective upper edges of the middle and lower panels when in the opened position.

2. The sleeve of claim 1, further comprising a reflective material attached on the back panel below the upper opening.

3. The sleeve of claim 2, wherein the reflective material is covered by the upper flap and is not visible when the upper flap is in the closed position and wherein the reflective material is uncovered by the upper flap and is visible when the upper flap is in the opened position.

4. The sleeve of claim 1, further comprising respective breathable mesh linings attached over each of the upper and lower openings on an inner side of the back panel.

5. The sleeve of claim 1, further comprising an insulating lining attached to an inner side of the sleeve.

6. The sleeve of claim 1, wherein at least one of the front and back panels is made from a weatherproof fabric or coated with a weatherproofing agent.

7. The sleeve of claim 1, wherein the garment is one or more of a sports garment, a jacket, and a running jacket.

8. The sleeve of claim 1, wherein respective upper edges of the front and back panels are attached to a body of the garment and wherein respective lower edges of the front and back panels form a cuff of the sleeve.

9. The sleeve of claim 8, wherein the front panel includes a gusset portion for attaching to the body of the garment.

10. The sleeve of claim 1, wherein at least one of the front panel, the upper panel, the middle panel, and the lower panel is made from a weatherproof fabric or coated with a weatherproofing agent.

11. The sleeve of claim 1, wherein respective first and second side edges of the upper, middle, and lower panels form at least a respective portion of the first and second side edges of the back panel, wherein an upper edge of the upper panel forms at least a portion of the upper edge of the back panel, and wherein a lower edge of the lower panel forms at least a portion of the lower edge of the back panel.

12. The sleeve of claim 1, wherein in the closed position, the upper and lower openings are closed by overlapping of the lower edges of the upper and middle panels over the upper edges of the middle and lower panels, respectively; and, wherein in the opened position, the upper and lower openings are opened by separation of the lower edges of the upper and middle panels from the upper edges of the middle and lower panels, respectively.

13. The sleeve of claim 12, wherein a reflective material is attached on the middle panel proximate the upper edge thereof.

14. The sleeve of claim 13, wherein the reflective material is covered by the lower edge of the upper panel and is not visible when the upper flap is in the closed position and wherein the reflective material is uncovered by the lower edge of the upper panel and is visible when the upper flap is in the opened position.

15. The sleeve of claim 13, further comprising respective breathable mesh linings attached over each of the upper and lower openings on an inner side of the back panel.

16. The sleeve of claim 15, further comprising respective insulating linings attached to respective inner sides of at least one of the front panel, the upper panel, the middle panel, and the lower panel.

* * * * *